US005603601A

United States Patent [19]

Winkelströter

[11] Patent Number: 5,603,601

[45] Date of Patent: Feb. 18, 1997

[54] COMPRESSOR WITH ATTACHMENTS MOUNTED ON STUBS OF A HOUSING OF THE COMPRESSOR

[75] Inventor: Walter Winkelströter, Wuppertal, Germany

[73] Assignee: Gebr. Becker GmbH & Co., Wuppertal, Germany

[21] Appl. No.: 353,246

[22] Filed: Dec. 2, 1994

[30] Foreign Application Priority Data

Dec. 3, 1993 [DE] Germany ..... 43 41 266.1

[51] Int. Cl.[6] ..... F04D 29/60

[52] U.S. Cl. ..... 415/55.1; 415/912; 137/271; 417/238

[58] Field of Search ..... 415/55.1, 912; 137/271; 417/238

[56] References Cited

U.S. PATENT DOCUMENTS

| | | | |
|---|---|---|---|
| 2,319,776 | 5/1943 | Copeland et al. | 415/55.1 |
| 3,355,095 | 11/1967 | Hollenberg | 415/55.1 |
| 3,360,193 | 12/1967 | Harris et al. | 415/55.1 |
| 3,395,853 | 8/1968 | Zoehfeld | 415/55.1 |
| 5,050,631 | 9/1991 | Konno et al. | 137/271 X |

FOREIGN PATENT DOCUMENTS 7441311 of 0000 Germany .

*Primary Examiner*—Edward K. Look
*Assistant Examiner*—Michael S. Lee
*Attorney, Agent, or Firm*—Antonelli, Terry, Stout & Kraus, LLP

[57] ABSTRACT

A lateral channel compressor having an annular flywheel housing (1) with air inlet stub (3) and air outlet stub (4). Attachments such as mufflers, filters, or safety valves are connected to stubs. A compact design and a lower manufacturing cost is achieved when the attachments are made in the form of a kit preferably having equal-length elements (I,II,III,IV) connectable directly to one another in the axial direction. The elements preferably have tubular main housings (11, 12) flush with one another. The filter and safety valve attachments (II, III, IV) each have a housing stub (13) projecting laterally from main housing (12) for mounting of filter elements and valve components.

25 Claims, 8 Drawing Sheets

COMPRESSOR WITH ATTACHMENTS MOUNTED ON STUBS OF A HOUSING OF THE COMPRESSOR

BACKGROUND OF THE INVENTION

1. Field of the Invention

The invention relates to a lateral channel compressor with an annular housing with air intake and air outlet stubs, with attachments such as mufflers, filters, or safety valves connected to the stubs.

2. Description of the Prior Art

Lateral channel compressors are equipped with different attachments depending on the application. It is known that attachments having simple functions, for example mufflers or filters, can be provided and the required attachment can be screwed onto the air intake or air outlet stub. However, because of the variety of different types of attachments which are required, manufacture and stocking of such attachments is expensive. It is also known to connect filter or safety valve attachments to tubular muffler attachments, but this generally leads to extensive branching and different overall dimensions of the lateral channel compressor, which can lead to problems regarding the space requirements at the installation site and is also visually unattractive in many cases because of the overall appearance.

SUMMARY OF THE INVENTION

The object of the invention is to provide attachments for a lateral channel compressor that are more economical to manufacture, assemble, and store, and which permit a compact overall design of the lateral channel compressor that is always nearly uniform in its overall appearance.

To achieve this objective in accordance with the invention attachments preferably in the form of a kit of elements are provided connectable directly with one another in their axial directions, said elements each having a tubular main housing. The invention makes it possible to mount the required attachments, preferably of equal length, on the intake or exhaust stubs, and to combine them in the form of compact towers, so that lateral channel compressors equipped in different ways in accordance with the invention will always have an approximately identical overall appearance, and it will always be possible to have essentially equal space requirements at the installation site.

According to a particular embodiment of the invention, stubs and the attachments attached thereto extend vertically from the annular plane of the lateral channel compressor, and preferably extend close to the drive motor of the lateral channel compressor.

Preferably, the tubular main housings of the attachments mesh with one another.

In an improved embodiment of the invention an elbow can be mounted on each stub so that it fits between the stub and the attachments, with the outlet axis in the installed position being directed parallel to the annular plane of the lateral channel compressor, so that the connected attachments extend close to and along one of the ends of the lateral channel compressor. In a lateral channel compressor with the stub directed perpendicularly to its annular plane, a 90° elbow is provided. In a lateral channel compressor with a stub directed radially a 180° elbow is used. In all the embodiments at the invention, a highly compact, compressed overall design is achieved.

Preferably the attachments connected to one another, together with an upper sealing cap, can be held together by means of tightening bolts that pass through and engage threaded holes in the intake and exhaust stubs, so that uniform fastening means can be employed in every case. In general, two attachments will suffice for intake and exhaust stubs, in which case the tensioning bolts will be long enough to clamp two attachments together. As a result of the invention, however, three or more attachments can be arranged in sequence, in which case it is merely necessary to use correspondingly longer tensioning bolts. This considerably simplifies assembly. Only the individual functional attachments need to be stocked, making manufacture and storage cheaper and reducing the number of different types required in the prior art.

According to a preferred improvement on the invention, provision can be made such that the filter and safety valve attachments have housing stubs projecting laterally from the main housing for mounting the filter elements and valve components. The housings of these attachments are advantageously made identical in order to reduce cost, with the filter attachment having one closed end cap and the safety valve attachments each having an end cap that is provided with an opening and which can be screwed onto the housing stubs.

According to another embodiment of the invention, the main housing has a step-shaped partition in an axial section, a through opening coaxial with respect to the housing stub is provided in the stepped wall parallel to the axis of the main housing, and a mount open to the housing stub is provided on the stepped wall for a tubular filter element insertable in the housing stub. These measures make it possible to locate the filter element with a portion of its length inside the main housing so that the housing stub that receives the rest of the filter element can be made correspondingly shorter, and consequently the compact overall design is not significantly adversely affected by these housing stubs.

Advantageously the valve components can be held by a disk clamped between the end of the housing stub and the matching end cap.

In addition, provision can also be made such that the kit comprises both muffler attachments of system length as well as of double system length. In many cases, only one muffler is required for an intake stub or outlet stub. This muffler according to the invention can then be provided either by two muffler attachments of system length or by only one muffler attachment of twice the system length. It is also possible for the main housing to have a step-shaped partition in the axial section, for the stepped wall parallel to the axis of the main housing to be provided with a through opening coaxial with the housing stub, and for a mount open to the housing stub to be provided on the stepped wall for a tubular filter element that fits into the housing stub, with the filter element having approximately one third or more of its length inside the main housing.

BRIEF DESCRIPTION OF THE DRAWINGS

Embodiments of the invention will now be described in greater detail with reference to the drawings.

DESCRIPTION OF THE PREFERRED EMBODIMENT

Figure 1:
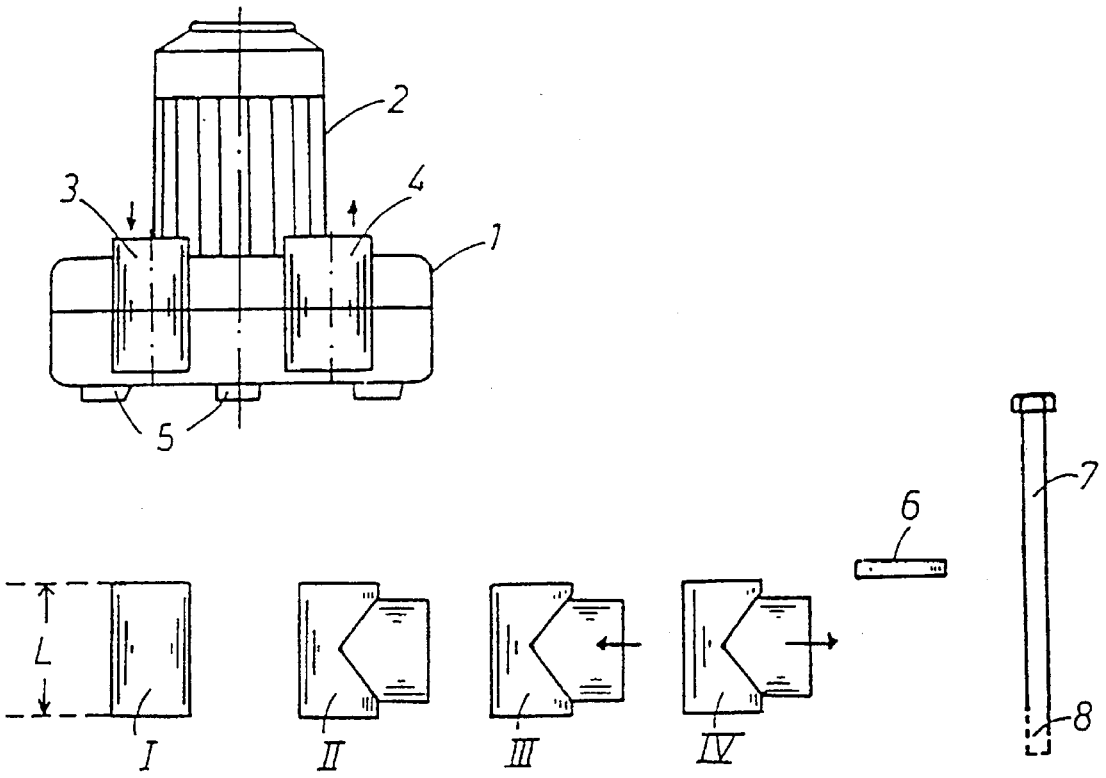
FIG. 1 is a simplified view of a kit for constructing a lateral channel compressor according to the invention.
Figure 2:
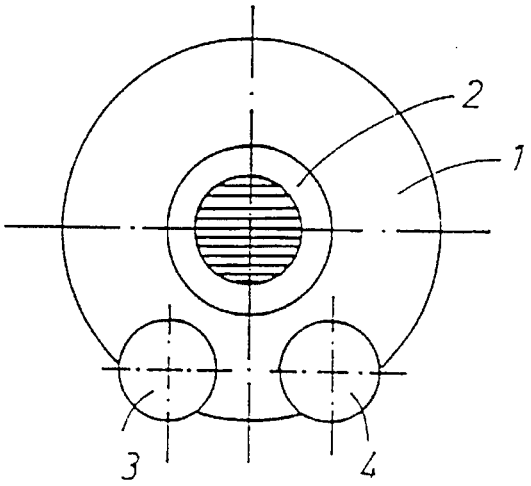
FIG. 2 is a top view of the flywheel housing of the lateral channel compressor.

FIG. 1 shows an annular two-shell housing of a lateral channel compressor with drive motor 2. Flywheel housing 1 is provided with an air intake stub 3 and an air outlet stub 4, each directed perpendicularly to the plane of the annular housing 1 as also illustrated in FIG. 2. FIG. 1 shows a single-stage lateral channel compressor standing on feet 5. The invention can also be used in similar fashion in lateral channel compressors located in a reclining position and also in two-stage lateral channel compressors.

Figure 11:
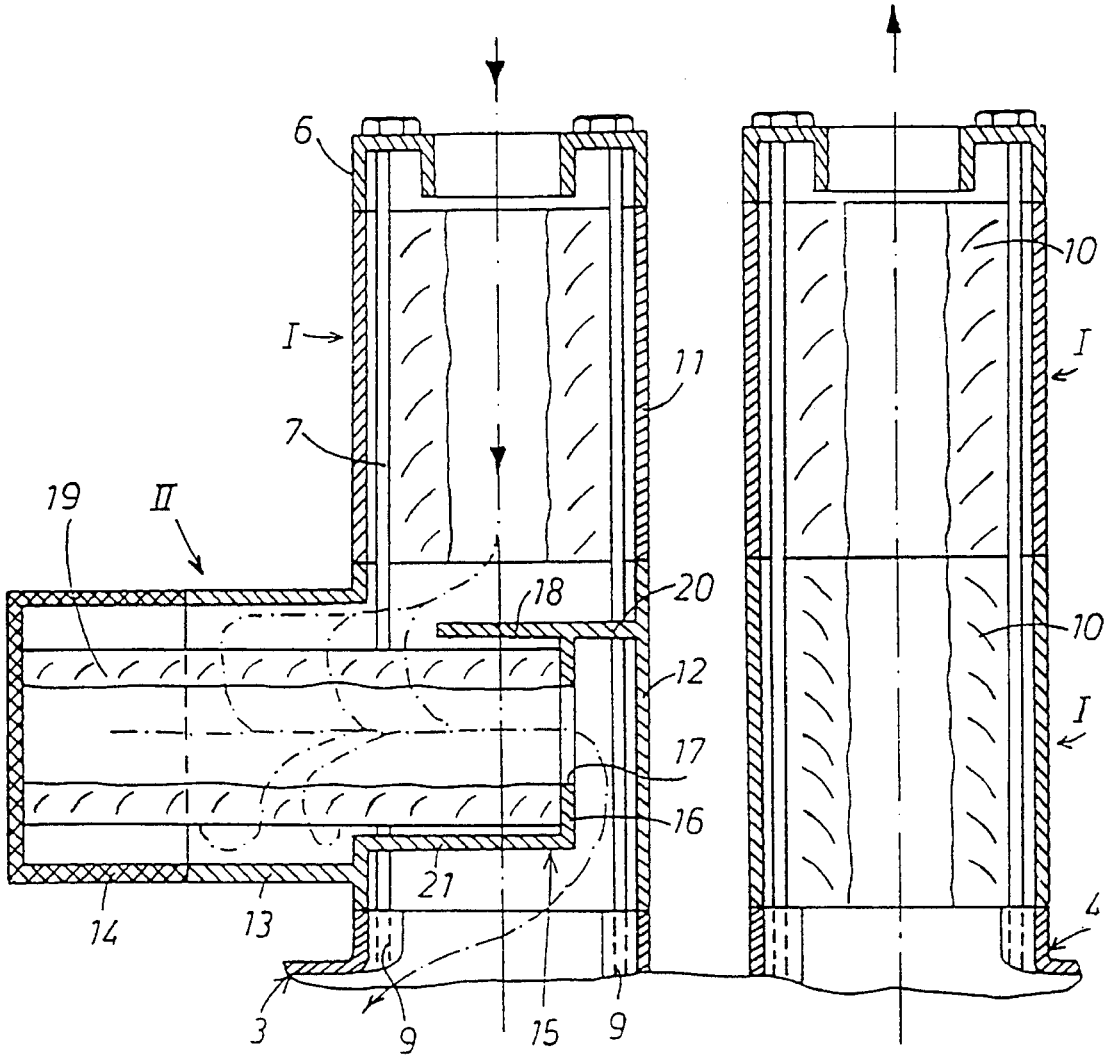
FIGS. 11 to 14 show on an enlarged scale and in an axial section, four variations for fitting a lateral channel compressor with attachments.

The lateral channel compressor has a plurality of attachments I, II, III, IV associated with it and connectable to stubs 3, 4, said elements being selected as a function of the requirements imposed and connected sequentially to stubs 3 and 4. The resultant attachment towers are provided at the top with a sealing cap 6, with the respective attachment towers together with cap 6 being clamped firmly to housing 1 by means of long head-tensioning bolts 7. Tensioning bolts 7 pass through the attachment towers thus formed and are screwed by their threaded ends 8 into corresponding threaded holes 9 provided in the vicinity of stubs 3, 4 as illustrated in FIG. 11.

Attachments I to IV all have the same system length L. Attachment I is a muffler; attachment II is a filter; attachment HI is a vacuum safety valve; and attachment IV is a pressure safety valve.

Figure 3:
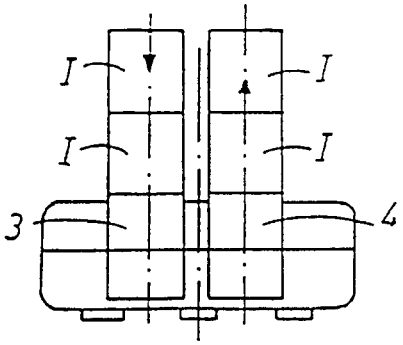
FIGS. 3 to 8 show six variations of the fitting of the lateral channel compressor with attachments according to FIG. 1.
Figure 4:
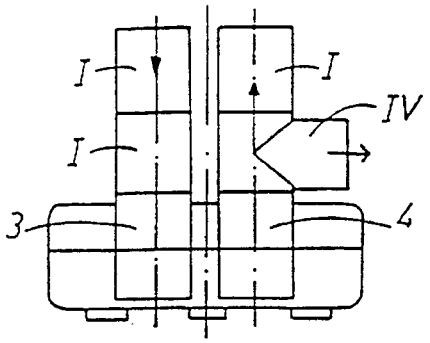
Figure 5:
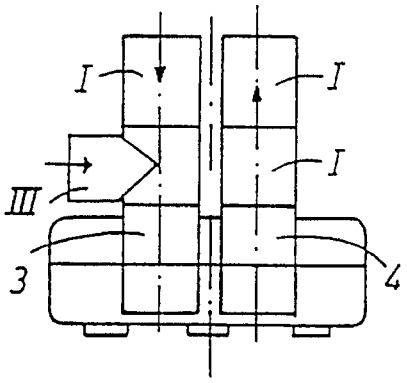
Figure 8:
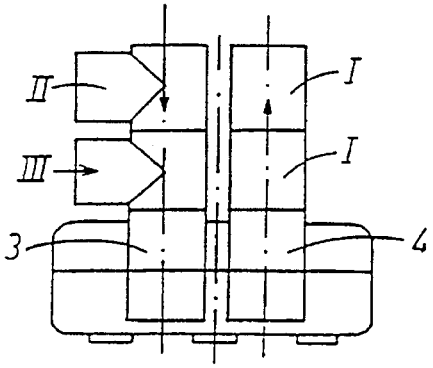

FIG. 3 shows schematically a lateral channel compressor having intake and outlet stubs 3, 4 two muffler at which attachments I are connected. In FIG. 4, two muffler attachments I are attached to intake stub 3 and a pressure safety valve attachment IV is connected to outlet stub 4, followed by a muffler attachment I. FIGS. 5 and 8 show additional possible variations in equipping lateral channel compressors with various attachments I, II, III, and IV. In all cases, a compact overall structure with nearly identical resultant total dimensions is achieved with a nearly uniform appearance. Additional variations are possible. For example in FIG. 8 attachments III and I attached to intake stub 3 could also be interchanged.

Figure 9:
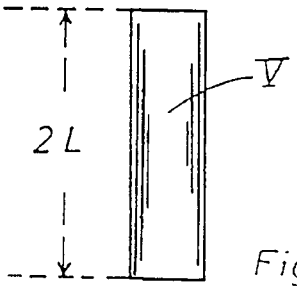
FIG. 9 shows another attachment.
Figure 10:
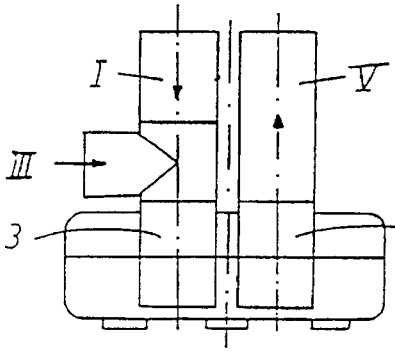
FIG. 10 shows a lateral channel compressor fitted with the attachments according to FIG. 9.

As FIGS. 3, 4, 5, 6 and 8 show, often only muffler attachments I are needed on stub 3 or 4 or on both stubs. In such cases, instead of two short muffler attachments I, muffler attachment V shown in FIG. 9 can be used which has twice the system length L. FIG. 10 shows use of muffler attachment 5 as an alternative to the embodiment shown in FIG. 5.

Figure 6:
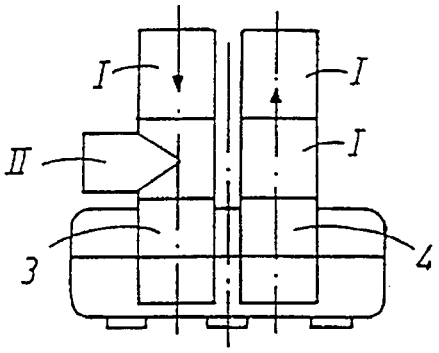
Figure 7:
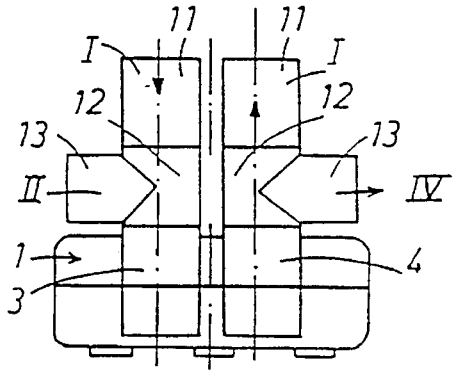

FIG. 11 shows, on an enlarged scale and in an axial section, the attachments used in the embodiment according to FIG. 6. Muffler attachments I mounted on outlet stub 4 are each provided with a muffler lining 10. A filter attachment H followed by a muffler element I are mounted on intake stub 3.

The housing of filter attachment II is made of a tubular main housing 12 that is flush with tubular housing 11 of muffler attachment I, from which main housing a housing stub 13 projects laterally that is closable by a screwable end cap 14. Main housing 12 has a partition 15 that is step-shaped in axial section internally, thus providing a through opening 17 in stepped wall 16 that is parallel to the axis of main housing 12. The opening 17 is located coaxially with respect to stub 13. On the side of stepped wall 16 that faces stub 13, a sleeve-shaped mount to open to stub 13 is provided, in which a tubular filter element 19 is pushed therein from one end. As is evident from FIG. 11, filter element 19 has more than one third of its length inside main housing 12. The air dram in through sealing cap 6 is deflected laterally by upper step wall 20 and sleeve-shaped mount 18 into stub 13. After passing through the jacket of filter element 19, the air flows through opening 17 into the chamber below lower stepped wall 21 and on to section stub 3.

Figure 12:
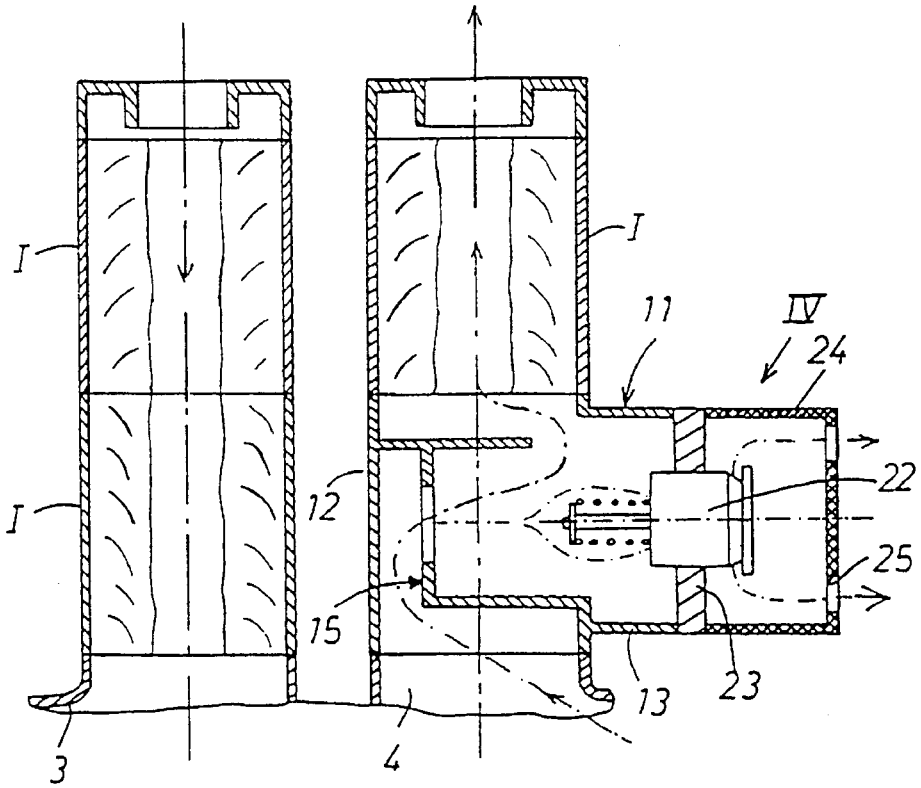

In the embodiment according to FIG. 12, a pressure safety valve attachment IV is mounted on outlet stub 4, followed by a muffler attachment I. The housing of attachment IV is identical to the housing of filter element II and includes main housing 12, housing stub 13, and step-shaped partition 15. Valve components 22 are supported by a disk 23 under tension located between the end of housing stub 13 and an end cap 24. The end cap 24 is located on the bottom with through openings 25.

Figure 13:
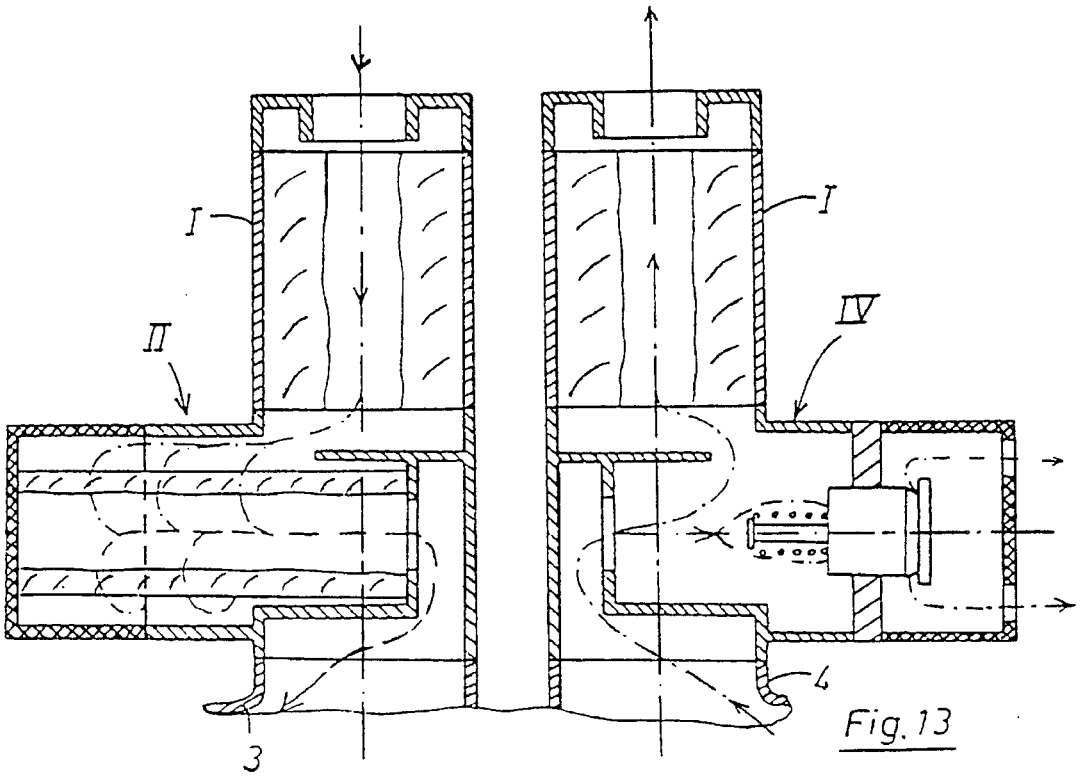

In the variation shown in FIG. 13, a filter attachment II and a muffler attachment I are mounted on intake stub 3 and a pressure safety valve attachment IV and a muffler attachment I are mounted on outlet stub 4.

Figure 14:
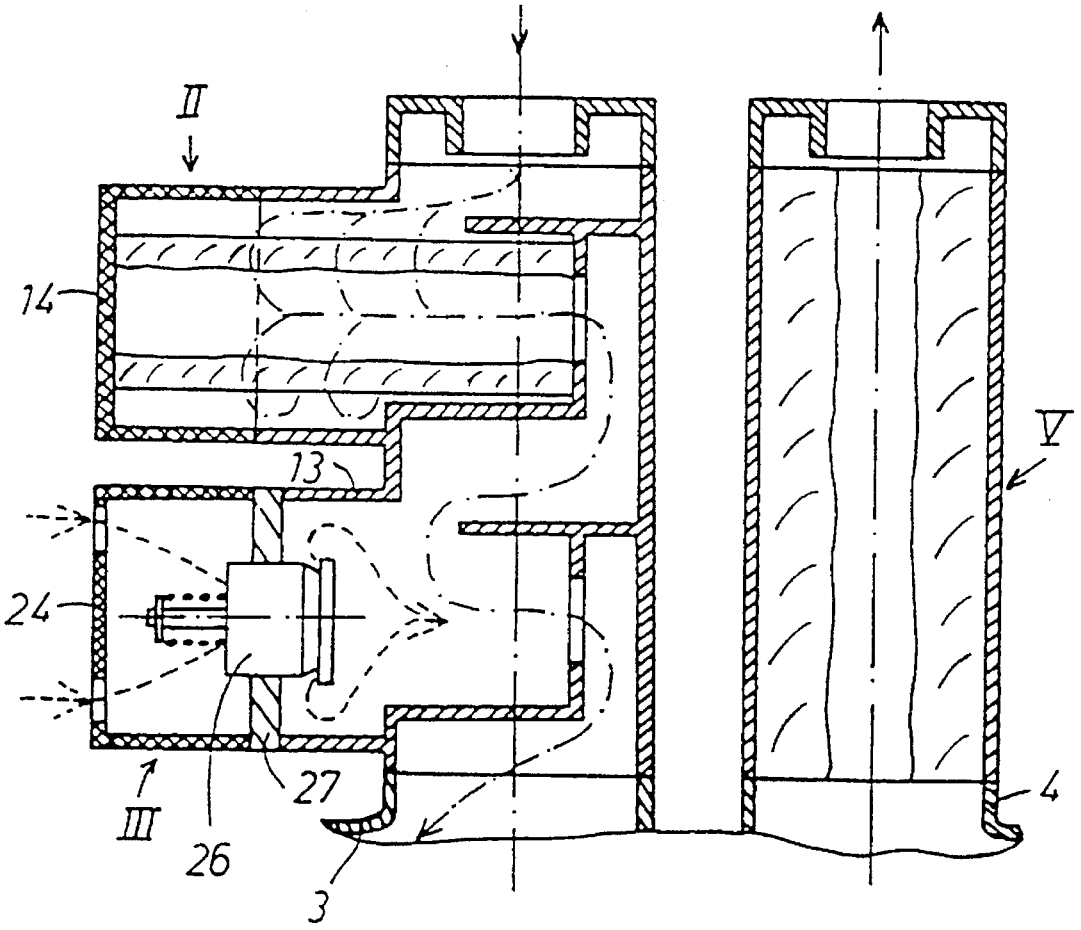

In the embodiment shown to FIG. 14, a vacuum safety valve attachment III and a filter attachment II are mounted on intake stub 3 and double-length muffler attachment V is mounted on outlet stub 4. The same housing as in the case of attachments II and IV is used for attachment III with an identical end cap 24 to that used for attachment III being used. Valve components 26 are once again supported by a disk 27 clamped between housing stub 13 and end cap 24. The housings of attachments II, and III are combined here into a uniform housing with double the system length.

Figure 15:
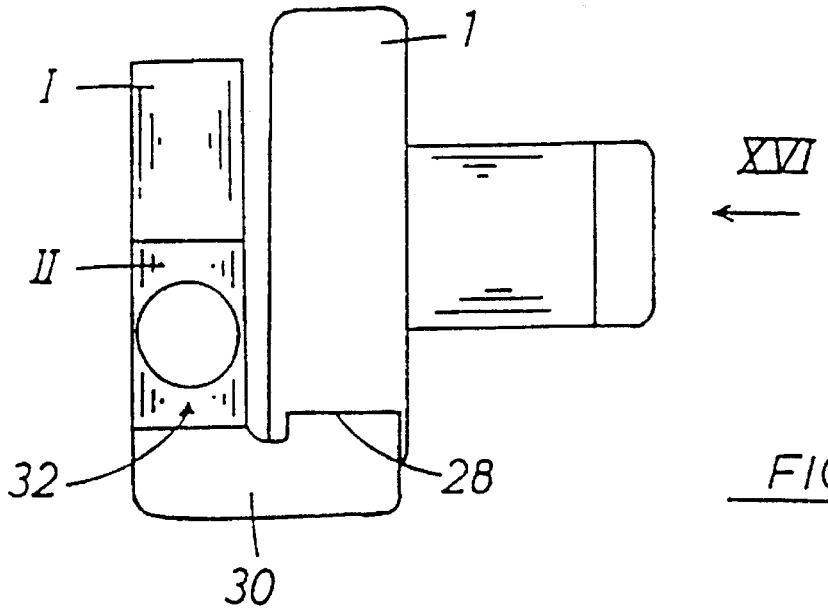
FIG. 15 is a modified embodiment of a lateral channel compressor according to the invention.
Figure 16:
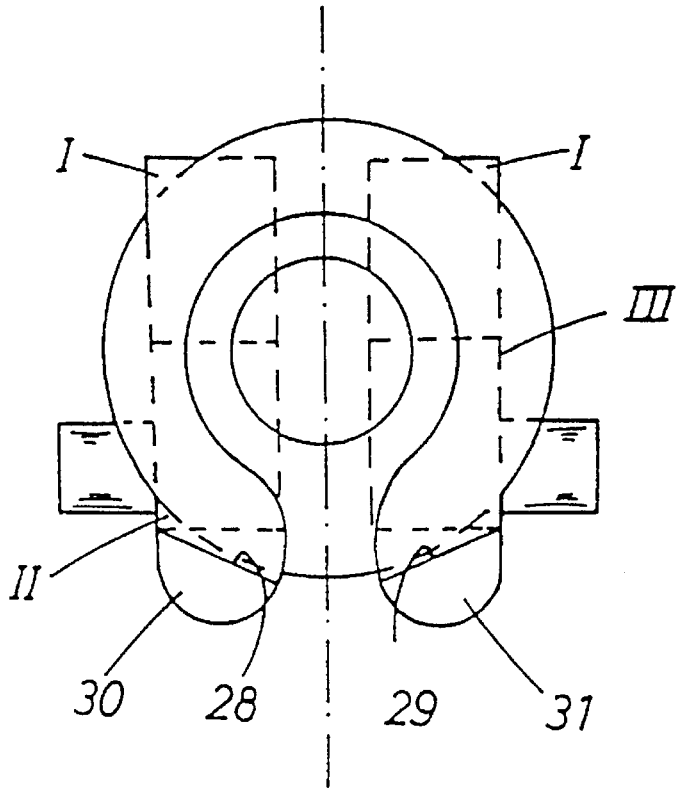
FIG. 16 is a top view of the lateral channel compressor, viewed in the direction of arrow XVI in FIG. 15.
Figure 17:
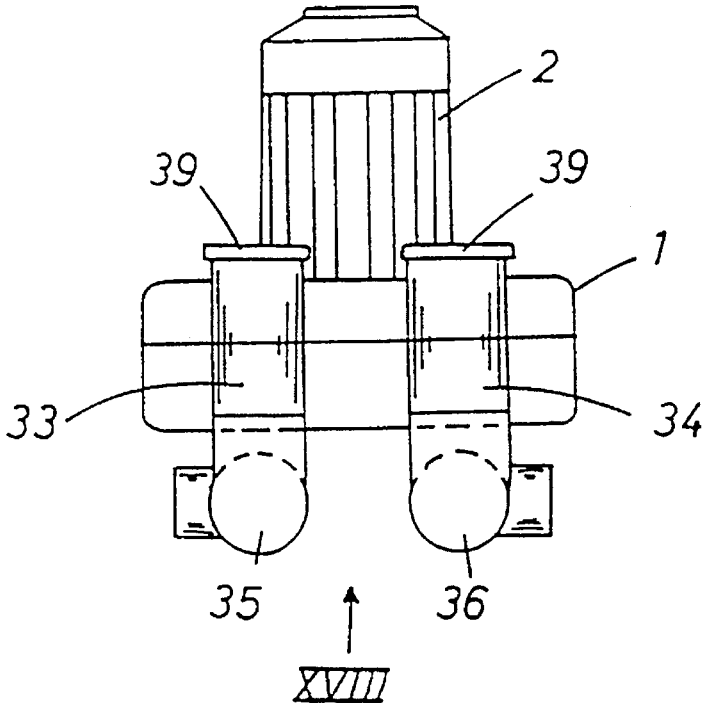
FIG. 17 is another embodiment of a lateral channel compressor according to the invention.
Figure 18:
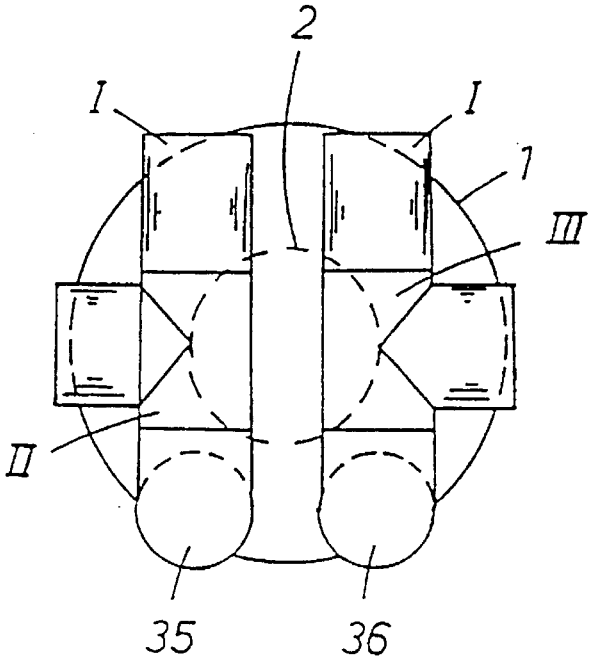
FIG. 18 is a bottom view of the lateral channel compressor, viewed in the direction of arrow XVII in FIG. 17.

FIGS. 15 and 16 show an embodiment in which flywheel housing 1 has radially-directed connecting stubs 28, 29. Here, 180° elbows 30, 31 are connected directly to connecting stubs 28, 29. The outlet axes 32 of the elbows are directed parallel to the annular plane of housing 1. Once again attachments I, II, III are connected to the outlet sides of elbows 30, 31, with the attachments extending parallel to the annular plane of flywheel 1 and on the side opposite drive motor 2 in the embodiment as illustrated.

In the embodiment according to FIGS. 17 to 20, the flywheel housing once again has axially directed stubs 33, 34 which are open at both ends, fitted with attachments I, II, and III with 90° elbows 35, 36 or 37, 38 connected to one end. The unused end of the connecting stub is covered by a cap 39. In the embodiment shown in FIGS. 17, 18, attachments I, II, III extend parallel to the annular plane of the lateral channel compressor, on the side away from motor 2.

Figure 19:
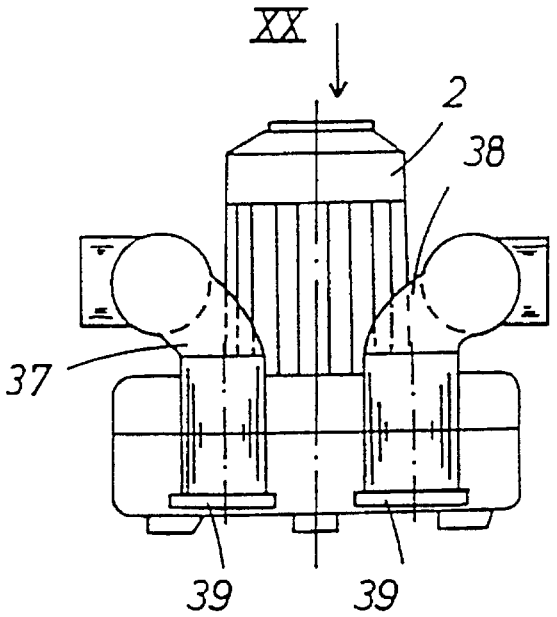
FIG. 19 is another embodiment of a lateral channel compressor.
Figure 20:
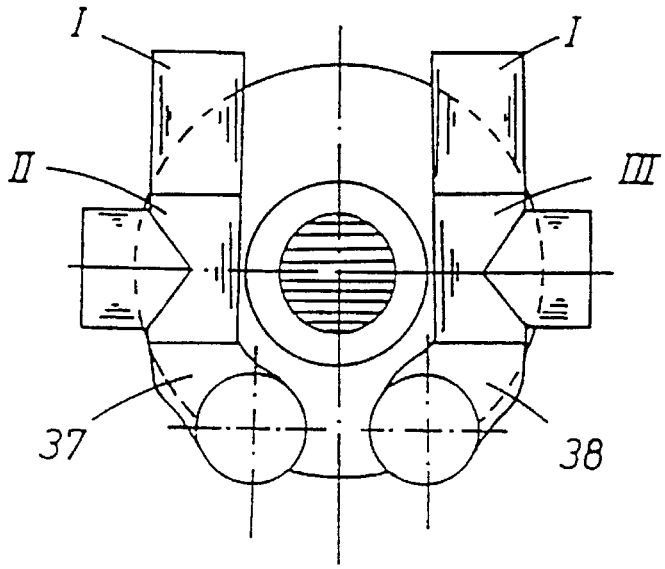
FIG. 20 is a top view of the lateral channel compressor, viewed in the direction of arrow XX in FIG. 19.

In the embodiment shown in FIGS. 19 and 20, attachments I, H, III extend next to the end of the flywheel facing motor 2, and the attachments enclose motor 2 between them. Since connecting stubs 33, 34 as a rule are arranged closer together than the outside diameter of motor 2. Elbows 37, 38 are additionally bent slightly outward here so that attachments I, II, III can be guided past motor 2.

LIST OF REFERENCE NUMERALS

1. Housing
2. Drive motor
3. Air intake stub
4. Air outlet stub
5. Feet
6. Sealing cap
7. Head tensioning bolt
8. Threaded end
9. Threaded bore
10. Muffler lining
11. Housing
12. Main housing
13. Housing stubs
14. End cap
15. Partition
16. Stepped wall
17. Through opening
18. Mount
19. Filter element
20. Stepped wall
21. Stepped wall
22. Ventilation components
23. Disk
24. End cap
25. Through opening
26. Valve components
27. Disk
28. Connecting stub
29. Connecting stub
30. 180° elbow
31. 180° elbow
32. Outlet axis
33. Connecting stub
34. Connecting stub
35. 90° elbow
36. 90° elbow
37. 90° elbow
38. 90° elbow
39. Cap
L System length
I Attachment
II Attachment
III Attachment
IV Attachment
V Attachment

I claim:

1. A lateral channel compressor comprising:

an annular housing which defines a plane;

an air intake stub and an air outlet stub attached to the housing with at least one of the stubs being perpendicular to the plane;

a plurality of attachments mounted on the stubs, and comprising a kit of elements, the attachments being connectable to each other in an axial direction of the attachments and each having a tubular housing; and wherein the tubular housing of each attachment is flush for mounting with another tubular housing such that each of the tubular housings have substantially matching external dimensions.

2. A lateral channel compressor in accordance with claim 1 wherein:

each tubular housing has an identical length.

3. A lateral channel compressor in accordance with claim 1 wherein:

the attachment comprises a muffler having a length which is equal to or twice the minimum axial length.

4. A lateral channel compressor in accordance with claim 1 wherein:

each attachment has a different function when attached to the compressor.

5. A lateral channel compressor in accordance with claim 1 wherein:

the stubs and attachments extend perpendicular to the plane of the annular flywheel housing.

6. A lateral channel compressor in accordance with claim 5 further comprising:

a plurality of seal caps with a different seal cap being attached to a different one of the plurality of attachments with at least one bolt passing through a plurality of the attachments and engaging threaded holes in the stubs.

7. A lateral channel compressor in accordance with claim 6 wherein the attachments comprise:

a filter and a safety valve which each have a housing stub projecting from the housing.

8. A lateral channel compressor in accordance with claim 7 wherein:

each safety valve is supported by a disk clamped between an end of the housing stub contained in the housing and an end cap of at least one of the air intake and outlet stubs.

9. A lateral channel compressor in accordance with claim 7 wherein:

the housing of the filter and the safety valve are identical and the filter has a closed end cap and the safety valve has an end cap which has an opening.

10. A lateral channel compressor in accordance with claim 9 wherein:

the housing has a partition having a step shaped axial section with a stepped wall parallel to an axis of the housing having an opening coaxial with a housing stub and a mount open to the housing stub located on the stepped wall; and the filter is tubular and is inserted in the housing stub with at least one third of a length of the tubular filter being inserted in the housing stub.

11. A lateral channel compressor in accordance with claim 9 wherein:

each safety valve is supported by a disk clamped between an end of the housing stub contained in the housing and an end cap of at least one of the air intake and outlet stubs.

12. A lateral channel compressor in accordance with claim 1 further comprising:

a plurality of elbows with one end of each of the plurality of elbows being fitted to a different stub and to one of the plurality of attachments with an outlet axis of each of the plurality of elbows being mounted parallel to the annular plane and the attachments extending along an end of the lateral compressor.

13. A lateral channel compressor in accordance with claim 12 further comprising:

a plurality of seal caps with a different seal cap being attached to a different one of the plurality of attachments with at least one bolt passing through a plurality of the attachments and engaging threaded holes in the stubs.

14. A lateral channel compressor in accordance with claim 13 wherein the attachments comprise:

a filter and a safety valve which each have a housing stub projecting from the housing.

15. A lateral channel compressor in accordance with claim 14 wherein:

each safety valve is supported by a disk clamped between an end of the housing stub contained in the housing and an end cap of at least one of the air intake and outlet stubs.

16. A lateral channel compressor in accordance with claim 21 wherein:

the housing of the filter and the safety valve are identical and the filter has a closed end cap and the safety valve has an end cap which has an opening.

17. A lateral channel compressor in accordance with claim 16 wherein:

the housing has a partition having a step shaped axial section with a stepped wall parallel to an axis of the housing having an opening coaxial with a housing stub and a mount open to the housing stub located on the stepped wall; and the filter is tubular and is inserted in the housing stub with at least one third of a length of the tubular filter being inserted in the housing stub.

18. A lateral channel compressor in accordance with claim 16 wherein:

each safety valve is supported by a disk clamped between an end of the housing stub contained in the housing and an end cap of at least one of the air intake and outlet stubs.

19. A lateral channel compressor in accordance with claim 1 further comprising:

a plurality of seal caps with a different seal cap being attached to a different one of the plurality of attachments with at least one bolt passing through a plurality of the attachments and engaging threaded holes in the stubs.

20. A lateral channel compressor in accordance with claim 19 wherein the attachments comprise:

a filter and a safety valve which each have a housing stub projecting from the flywheel housing.

21. A lateral channel compressor in accordance with claim 20 wherein:

each safety valve is supported by a disk clamped between an end of the housing stub contained in the housing and an end cap of at least one of the air intake and outlet stubs.

22. A lateral channel compressor in accordance with claim 19 wherein:

the housing of the filter and the safety valve are identical and the filter has a closed end cap and the safety valve has an end cap which has an opening.

23. A lateral channel compressor in accordance with claim 22 wherein:

the housing has a partition having a step shaped axial section with a stepped wall parallel to an axis of the housing having an opening coaxial with a housing stub and a mount open to the housing stub located on the stepped wall; and the filter is tubular and is inserted in the housing stub with at least one third of a length of the tubular filter being inserted in the housing stub.

24. A lateral channel compressor in accordance with claim 22 wherein:

each safety valve is supported by a disk clamped between an end of the housing stub contained in the housing and an end cap of at least one of the air intake and outlet stubs.

25. A kit for use with a lateral channel compressor having an annular housing, an air intake stub and an air outlet stub attached to the housing comprising:

a plurality of attachments which are dimensioned to be connectable together in an axial direction of each attachment, each attachment having a tubular housing which is flush with another tubular housing and a mounting mechanism for attachment to the stubs; and wherein the tubular housing of each attachment is flush for mounting with another tubular housing such that each of the tubular housings have substantially matching external dimensions.

* * * * *